United States Patent [19]

Pope

[11] Patent Number: 4,591,320

[45] Date of Patent: May 27, 1986

[54] SUBMERSIBLE PUMPING UNIT

[76] Inventor: Kenneth E. Pope, Rte. #3, Box 217, Wagoner, Okla. 74467

[21] Appl. No.: 575,511

[22] Filed: Jan. 31, 1984

[51] Int. Cl.[4] ..... F04B 47/08

[52] U.S. Cl. ..... 417/390; 417/393

[58] Field of Search ..... 417/390, 393, 396, 517, 417/520

[56] References Cited

U.S. PATENT DOCUMENTS

| | | | |
|---|---|---|---|
| 2,307,566 | 1/1943 | Browne | 417/393 |
| 2,641,187 | 6/1953 | Adams | 417/396 |
| 3,048,115 | 8/1962 | Musser | 417/393 |
| 3,091,181 | 5/1963 | Wolf | 417/390 |
| 4,084,923 | 4/1978 | Roeder | 417/396 X |
| 4,234,295 | 11/1980 | Jensen | 417/390 |

*Primary Examiner*—Leonard E. Smith

[57] ABSTRACT

A rodless submersible down hole pumping unit for a producing oil and/or gas well and including in combination a submersible prime mover operably connected with a source of electrical power from the surface of the ground through a suitable electrical cable. A pressure fluid source, a fluid moving pump operably connected with the motor for actuation thereby, a shifting valve assembly operable between the fluid moving pump and a shift rod assembly for transmitting reciprocation to a piston rod, the piston rod cooperating with a product valve unit for drawing well fluid from the fluid reservoir of the oil and/or gas well into the interior of the apparatus and discharging the well from the interior of the apparatus into the well tubing during continued reciprocation of the piston rod whereby the well fluid may be delivered to the surface of the ground for recovery thereof.

4 Claims, 9 Drawing Figures

SUBMERSIBLE PUMPING UNIT

BACKGROUND OF THE INVENTION

1. Field of the Invention

This invention relates to improvements in pumping apparatus and more particularly, but not by way of limitation, to a submersible down hole pumping unit for a producing oil and/or gas well, or the like.

2. Description of the Prior Art

The fluid in many producing oil and/or gas wells is elevated to the surface of the ground by the action of a pumping unit or pumping apparatus installed in the lower portion of the well bore. These pumping units are commonly known as down hole pumps, and are activated by a sucker rod string which extends downwardly through the well bore for connecting reciprocating surface equipment with the pump for activation thereof. It is frequently common practice to install the down hole pump in upwardly spaced relation with respect to the fluid reservoir within the well bore, and the pumping action pulls the well fluid into the interior of the well tubing and pushes the accumulated fluid upwardly through the well tubing to the surface of the ground for recovery thereof. In recent times, however, there has been increased activity in the drilling of well bores through a considerably great distance into the earth, as for example twenty thousand feet and more, and it has become necessary or desirable to install the down hole pump within the fluid reservoir. In addition, the use of water flooding for additional fluid recover in oil fields wherein the production of the sub-surface fluid has been somewhat depleted has produced a considerable quantity of down hole fluid in the well bore. As a result it has become essential or necessary to install down hole pumps within the fluid contained within the well bore. This has created a need for pumping units to perform tasks not efficient or practical with the widely used down hole pumps in existence today.

In an effort to solve some of the problems created by the increased depth of the well bores, the sucker rod pumps have been improved by the adaptation of hydraulic drives for the sucker rod but this solution falls short of solving the problem, particularly in efficiency of operation. It is estimated that approximately eighteen percent of the existing producing oil and/or gas wells that are in excess of eight thousand feet deep become economically impractical to be pumped by sucker rod pumping unit due to sucker rod fatigue.

Two major classes of down hole pumps have been developed for this newly arising market, namely, a submersible centrifugal pump manufactured and/or distributed by Reda Pump, Byron Jackson and ODI; and pumps manufactured by Kobe, and which are commonly known as Kobe pumps. The centrifugal pumps are approximately sixteen to twenty percent efficient HP in-put to produce recovered "up-hole" and usually required many stages to pump against the pressure heads involved in eight thousand feet lift operations and greater. The Kobe pump system requires either a double or triple tubing installation, but is efficient only to approximately fifty six percent hydraulic HP in-put to produce lifted out of the well bore.

Other pertinent information generally related to the subject matter is found in the following U.S. patents: Roeder U.S. Pat. No. 3,915,595, issued Oct. 28, 1975, and entitled "Double-Ended Hydraulically Actuated Downhole;" McArthur et al U.S. Pat. No. 3,849,030, issued Nov. 19, 1974, and entitled "Fluid Operated Pump with Opposed Pistons and Valve in Middle;" Lybecker et al U.S. Pat. No. 3,779,671, issued Dec. 18, 1973, and entitled "Hydraulic Driven Piston Pump;" Chenault U.S. Pat. No. 3,374,746, issued Mar. 26, 1948, and entitled "Hydraulically Operated Subsurface Motor and Pump Combination;" Roeder U.S. Pat. No. 4,202,656, issued May 13, 1980, and entitled "Downhole Hydraulically Actuated Pump with Jet Boost;" Brown U.S. Pat. No. 4,120,612, issued Oct. 17, 1978, and entitled "Automatic Pump for Deep Wells;" Heard U.S. Pat. No. 3,918,845, issued Nov. 11, 1975, and entitled "High Volume Hydraulic Recoil Pump;" Pugh U.S. Pat. No. 3,922,116, issued Nov. 25, 1975, and entitled "Reversing Mechanism for Double-Action Hydraulic Oil Well Pump;" Spears U.S. Pat. No. 4,332,533, issued June 1, 1982, and entitled "Fluid Pump;" Gilbertson U.S. Pat. No. 4,320,799, issued Mar. 23, 1982, and entitled "Oil Well Pump Drive-in Unit;" Roeder U.S. Pat. No. 3,865,516, issued Feb. 11, 1975, and entitled "Fluid Actuated Down-Hole Pump;" Roeder U.S. Pat. No. 3,957,400, issued May 18, 1976, and entitled "Double-Ended Hydraulically Actuated Down-Hole Pump;" Roeder U.S. Pat. No. 3,650,640, and entitled "Downhole Pump Assembly Having Engines Spaced Apart By a Production Pump;" Roeder U.S. Pat. No. 3,517,741, issued June 30, 1970, and entitled "Hydraulic Well Pumping System;" Roeder U.S. Pat. No. 3,453,963, issued July 8, 1969, and entitled "Downhole Fluid Activated Pump Assembly;" Carrens U.S. Pat. No. 4,293,287, issued Oct. 6, 1981 and entitled "Reversing Valve Assembly for a Fluid Operated Well Pump;" Roeder U.S. Pat. No. 4,268,227, issued May 19, 1981, and entitled "Downhole, Hydraulically-Actuated Pump and Cavity Having Closed Power Fluid Flow;" Jensen U.S. Pat. No. 4,234,294, issued Nov. 18, 1980, and entitled "Deep Well Hydraulic Pump System Using High Pressure Accumulator;" Roeder U.S. Pat. No. 4,118,154, issued Oct. 3, 1978, and entitled "Hydraulically Actuated Pump Assembly;" Ferguson U.S. Pat. No. 3,162,143, issued Dec. 22, 1964, and entitled "Well Pumps;" Schmidt U.S. Pat. No. 3,164,102, issued Jan. 5, 1965, and entitled "Oil Well Pump;" Gage U.S. Pat. No. 3,910,730, issued Oct. 7, 1975, and entitled "Oil Well Pump;" Roeder U.S. Pat. No. 3,865,516, issued Feb. 11, 1975, and entitled "Fluid Actuated Down-Hole Pump;" Russell U.S. Pat. No. 4,087,206, issued May 2, 1978, and entitled "Subsurface Pumping Unit Incorporating Heavy Duty Reversing Valve and Method of Operating;" Sprenger U.S. Pat. No. 4,082,483, issued Apr. 4, 1978, and entitled "Oil Well Pump;" Roeder U.S. Pat. No. 4,080,111, issued Mar. 21, 1978, and entitled "High Volume, Double Acting Downhole Pump;" Gage U.S. Pat. No. 4,013,387, issued Mar. 22, 1977, and entitled "Oil Well Pump;" David U.S. Pat. No. 4,003,678, issued Jan. 18, 1977, and entitled "Fluid Operated Well Turbopump;" Soberg U.S. Pat. No. 3,941,516, issued Mar. 2, 1976, and entitled "Waterwell Pump Assembly;" Roeder U.S. Pat. No. 3,953,155, issued Apr. 27, 1976, and entitled "Pump Plunger;" Watson U.S. Pat. No. 3,965,983, issued June 29, 1976, and entitled "Sonic Fluid Level Control Apparatus;" Onal U.S. Pat. No. 3,981,626, issued Sept. 21, 1976, and entitled "Down Hole Pump and Method of Deep Well Pumping;" Scott U.S. Pat. No. 3,986,552, issued Oct. 19, 1976, and entitled "Pumping System for High Viscosity Oil;" Douglas U.S. Pat. No. 3,861,471, issued Jan. 21, 1975, and entitled "Oil Well Pump Having Gas Lock Prevention Means and Method of Use Thereof;" Saruwatari U.S. Pat. No. 4,114,375, issued Sept. 19, 1978, and entitled "Pump Jack Device;" Sarawatari U.S. Pat. No. 4,047,384, issued Sept. 13, 1977, and entitled "Pump Jack Device;" Smith U.S. Pat. No. 2,564,285, issued Aug. 14, 1951, and entitled "Pneumatic-Hydraulic System for Operating Well Pumping Equipment;" Aller et al U.S. Pat. No. 2,645,899, issued July 21, 1953, and entitled "Hydropneumatic Pumping Unit;" Becker U.S. Pat. No. 2,808,735, issued Oct. 8, 1957, and entitled "Automatic Counterbalance for Well Pumping Apparatus;" Jones U.S. Pat. No. 2,887,093, issued May 19, 1959, and entitled "Hydraulically Operated Pumping Apparatus;" and Johnston U.S. Pat. No. 2,247,238, issued June 24, 1941, and entitled "Hydropheumatic Pumping System." These devices, however, do not satisfy the needs nor overcome the disadvantages of the present available equipment as hereinbefore set forth.

SUMMARY OF THE INVENTION

The present invention contemplates a novel submersible down hole pump particularly designed and constructed for overcoming the foregoing disadvantages by a three way combination or "marriage" of technologies to produce an apparatus which is approximately sixty eight percent to eighty six percent efficient in operation. The pumping apparatus or unit is a long stroke, single acting down hole pump having a gas compression ratio of 22–484 for overcoming down hole gas locking under well production conditions wherein a "gassy" situation is encountered. In addition, the pumping unit is powered by a closed loop electric motor driven hydraulic pump and engine. The hydraulic pump is of a low pressure high volume gear pump design with the charge pressure thereof being self-adjusting to the encountered well lift pressures. The self adjusting is accomplished through equalized vents in the sucker rod string lift pressure. The pump and motor are thus required only to supply sufficient horse power to overcome friction due to the up-hole flow of the fluid and the vertical lift of the well fluid mass out of the well bore. The pressure across the pump seals is no greater than those in the present day down hole pumping equipment. The hydraulic load variations at the motor tend to drive the motor on the down stroke by the weight of the pump piston, thus the hydraulic pump will function as a motor tending to over-speed the electric motor on the down stroke, resulting in a down stroke more than one hundred percent efficient, electrically, or at least draw zero current from the power line. This variation in electrical current may be sensed at surface of the ground to measure the pumping stroke rate and ascertain the condition of the down hole equipment for facilitating the maintenance thereof. The novel submersible motor and pump provide a maximum output, and the stroke rate may be varied in accordance with the requirements of the particular well bore in which the equipment is installed, the stroke being variable from controls provided at the surface of the ground by a 2 to 1 ratio, 1350–3350 RPM by wiring and phasing of the motor winding as is well known in two speed fans, pump motors, and the like. The horse power normally required for a four hundred BBD from twenty thousand feet at the 60 HP motor are well within the limits of a #2 wire four wire (normally referred to as a two speed cable) extending into connection with the submersible motor, thus providing a practical construction for the apparatus. The charge pressure equalizes automatically in accordance with the pressure downstream in the well tubing as the novel apparatus "pumps up," thus requiring no special start-up procedures. Of course, in operating conditions wherein the down hole temperatures exceed the capabilities of the usual high temperature insulating materials, two pumps may be utilized, each pump being of a lower horse power than in a single pump installation in order to maintain the heat dissipation of the lowermost pumping unit winding within the specification limits therefor.

DETAILED DESCRIPTION OF THE PREFERRED EMBODIMENTS

Figure 1:
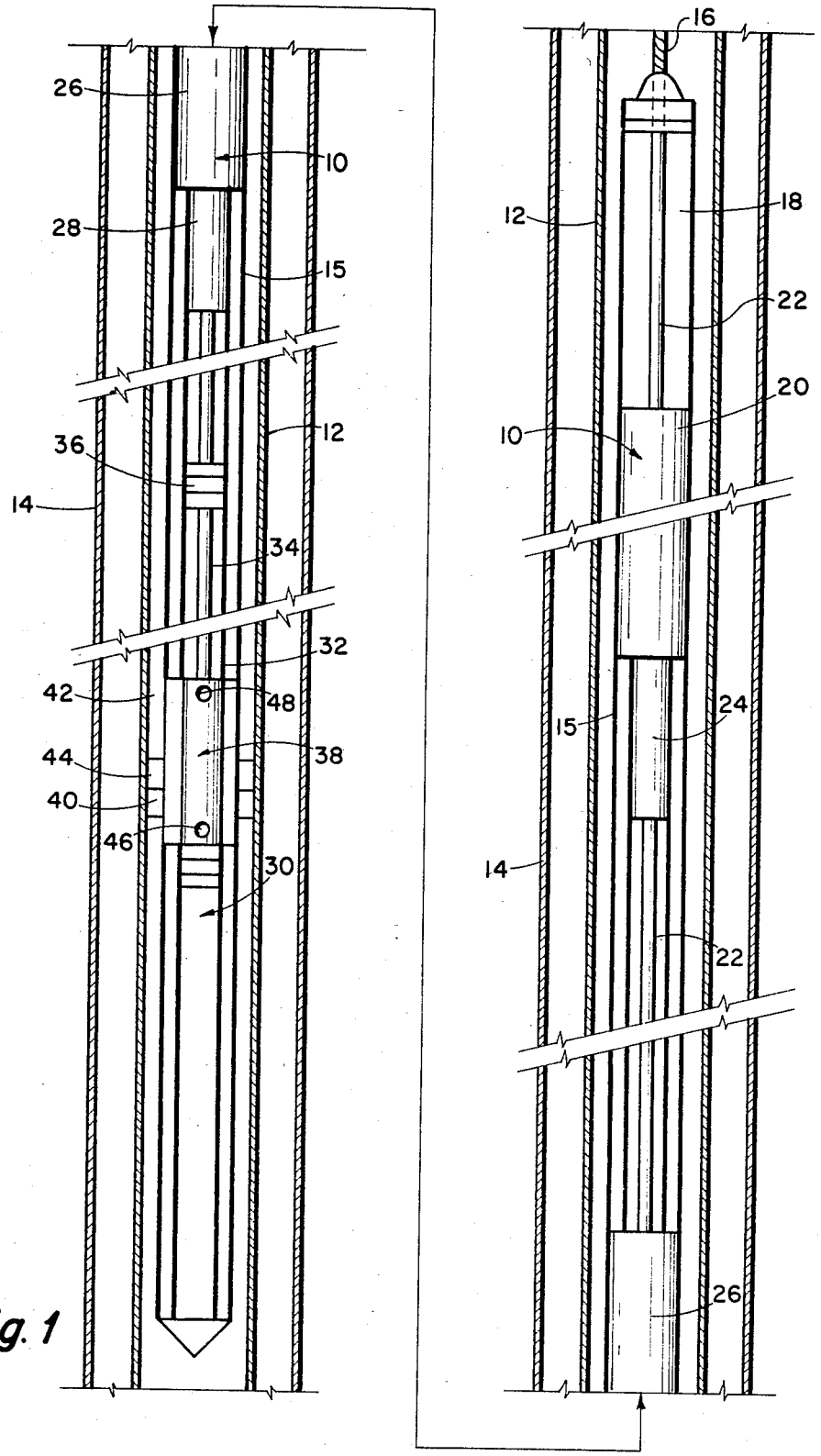
FIG. 1 is a schematic sectional elevational view of a submersible down hole pumping unit embodying the invention.

Referring to the drawings in detail, and particularly FIG. 1 wherein a general schematic-type illustration of the invention is shown, reference character 10 generally indicates a rodless submersible down hole pumping assembly adapted to be suspended or disposed within a well tubing 12 such as normally anchored or secured within a well casing 14 in a producing oil and/or gas well bore. The apparatus 10 comprises an elongated outer housing 15 which may be lowered and/or raised within the well tubing 12 in any suitable manner, such as by a cable 16 extending through the well tubing 12 and connected with the usual cable spooling drum (not shown) or the like normally provided at the surface of the ground, as is well known. The housing 15 as shown in FIG. 1 is in cross section, but the sidewalls are illustrated as solid lines due to the limitations of dimensions of the drawing. The uppermost portion of the housing 12 is filled with a suitable fluid, such as oil, providing an oil plenum 18 for the assembly 10.

A first suitable submersible motor means 20 is disposed within the housing 15 and within the plenum 18 and is in operable connection with a suitable power source (not shown) provided at the surface of the well bore by an electrical cable means 22, as is well known. The motor means 20 is preferably an electric motor of ten HP up to fifty HP, and may preferably be of a length from twenty nine inches to seventy eight inches, but not limited thereto. The motor means 20 is submerged in the suitable hydraulic fluid or oil within the plenum 18 to provide a closed system for the apparatus 10, as will be hereinafter set forth. A suitable pumping means 24, such as a hydraulic pump means, is disposed within the housing 15 below the motor means 20 and is operably connected with the motor means 20 in any well known manner for actuation thereby.

A second suitable submersible motor means 26 is disposed within the housing 15 and within the plenum 18 in spaced relation with respect to the first pump means 20 and hydraulic pump means 24, and is preferably disposed therebelow. The second motor means 26 is preferably identical with the first motor means 20, but not limited thereto, and a second pumping means 28, similar to the pumping means 24, is disposed in the plenum 18 below the second motor means 26 and operably connected therewith in any suitable manner for acutation thereby. Of course, the second motor means 26 is in operable connection with the electric cable 22, or a second cable, if desired, for receiving power therefrom, as is well known.

A pumping assembly generally indicated at 30 is disposed within the housing 15 below the hydraulic pumping means 28 and includes a housing means 32 and a reciprocal rod member 34 having a piston head 36 secured thereto for movement simultaneously therewith, as is well known. The rod means 34 is reciprocated within the housing 32 by the action of the hydraulic pumping means 28, and the interior of the housing 32 is open to the well fluid contained in the producing reservoir of the well bore through a suitable valving assembly 38. A suitable packer means 40 is secured between the outer periphery of the housing 15 and the inner periphery of the well tubing 12, as is well known, for precluding communication between the fluid reservoir within the well bore and the annulus 42 between the housing 15 and well tubing 12 above the packer means 40. In addition, a pump collar seal means 44 may be provided between the housing 15 and well tubing 12 for sealing the lower end of the plenum 18. The valving assembly 38 is in communication with the well fluid reservoir below the packer means 40 through a port 46 and in communication with the annulus 42 above the packer 40 through a point 48 whereby actuation of the reciprocal rod means 32 and piston head 34 pulls the well fluid into the pumping assembly 30 upon the upstroke and forces the well fluid from the pumping assembly and into the annulus 42 on the downstroke. The continued pumping action elevates the well fluid within the annulus 42 to the surface of the ground for recovery thereof. It will be apparent that the presence of fluid within the well bore has no detrimental effect on the efficient operation of the rodless submersible pumping assembly 10, and since there is no dependency on any sucker rod string, the well bore may be of substantially any depth without adversely affecting the efficient operation of the apparatus 10.

Figure 2:
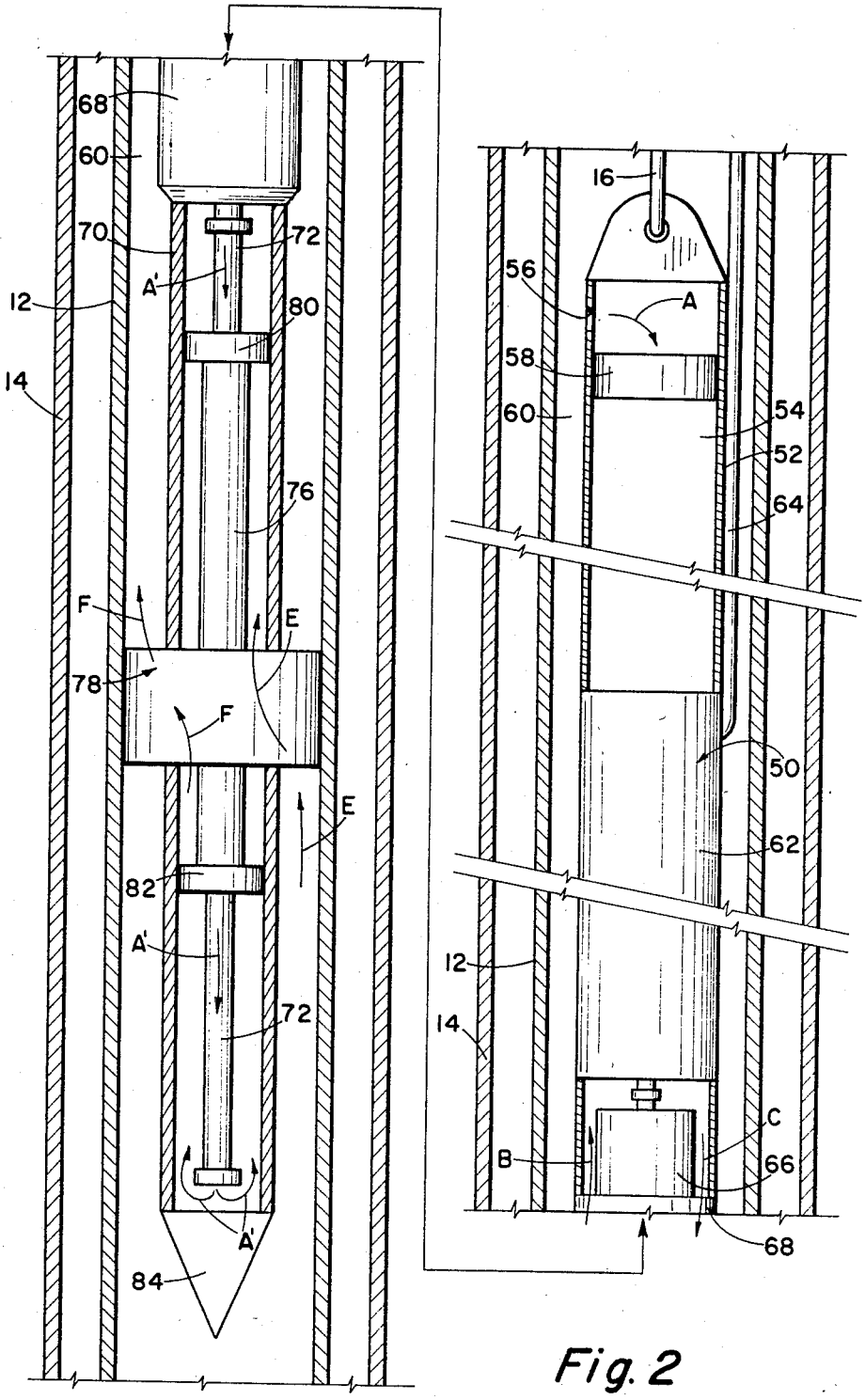
FIG. 2 is a sectional elevational view of a preferred embodiment of a submersible down hole pumping unit embodying the invention.

Referring now to FIG. 2, a preferred embodiment of the invention is shown wherein a rodless submergible down hole pumping assembly or apparatus is generally indicated by reference numeral 50 and comprises a housing 52 adapted to be suspended or supported within the well tubing 12 in any well known manner, such as by the cable 16 as hereinbefore set forth. A chamber 54 is provided within the housing 52, and is filled with a suitable fluid, such as oil. At least one port 56 is provided in the housing 52 providing communication between the exterior of the housing and the chamber 54, and preferably disposed at the upper end of the chamber 54. A free floating piston 58 is disposed within the chamber 54 below the port 56 and the fluid pressure within the annulus 60 between the outer periphery of the housing 52 and the inner periphery of the well tubing 12 is admitted into the chamber 54 for acting against the upper end of the piston 58 as indicated by the arrow A. A suitable submersible motor 62 is disposed within the chamber 54 and surrounded by the fluid therein, as hereinbefore set forth in connection with the motors 20 and 26. The motor 62 is preferably a twenty five HP AC submersible motor, but not limited thereto, and is operably connected with a source of electrical power through an electrical cable means 64. The cable means 64 extends to the surface of the well for operable connection with a power source (not shown) as is well known in the industry.

A suitable hydraulic pumping means 66 is disposed within the housing 52 below the motor 62, and is operably connected thereto for actuation thereby, as is well known. A shifting valve assembly 68 is disposed substantially immediately below the hydraulic pumping means 66 and is in open communication thereto for circulating fluid thereto in one shifting position of the valve and as shown by the arrow B, and drawing fluid therefrom in a second shifting position of the valve as shown by the arrow C.

A reduced diameter sleeve or housing 70 extends downwardly from the shifting valve means 68, and a shift tube 72 extends disposed within the housing 70 and is connected with the shifting valve assembly 68 for reciprocation thereby. The shift tube 72 extends reciprocally through a piston rod means 76 which extends reciprocally through a product valving assembly 78. A first piston head 80 is secured to or provided on the piston rod means 76 between the valve assembly 78 and the shifting valve assembly 68. A second piston head 82 is provided on the piston rod means 76 on the opposite side of the product valve assembly 78 with respect to the piston head 80. The outer or lower end of the reduced diameter housing 70 is closed in any suitable manner, such as by an end plug means 84, and the outer end of the shift tube 72 is open to the interior of the housing 70. In addition, the product valve assembly 78 is open to the well fluid in the fluid reservoir, and to the annulus 60 as set forth in connection with the embodiment shown in FIG. 1, and as will be hereinafter set forth in detail.

The fluid in the housing 52 is utilized as the fluid for the hydraulic pumping means 66, and as the pumping means 66 is actuated by the motor 62, the shifting valve 68 directs the fluid to and from the shift tube 72 for reciprocation thereof. The fluid is also directed longitudinally through the shift tube 72 during the reciprocation thereof. As the shift tube 72 moves in one direction, the fluid moving therethrough in the direction indicated by the arrows A' is discharged into the housing 70 beneath the second piston head 82. The application of the fluid pressure against the piston head 82 moves the piston rod 76 in a direction for actuation of the product valving 78 whereby the well fluid is pulled from the fluid reservoir in the well bore and delivered into the housing 70 and accumulated between the piston heads 80 and 82 as indicated by the arrows E. At the same time, the fluid previously accumulated within the area between the piston heads 80 and 82 is delivered into the annulus 60 through the product valve 78, as indicated by the arrow F. Of course, the hydraulic fluid moving through the shift tube 72 is continually recirculated through the tube 72 and shifting valve assembly 68 to produce a continual pumping action for the apparatus 50 whereby the well fluid may be delivered to the surface of the well bore for recovery thereof.

Figure 3:
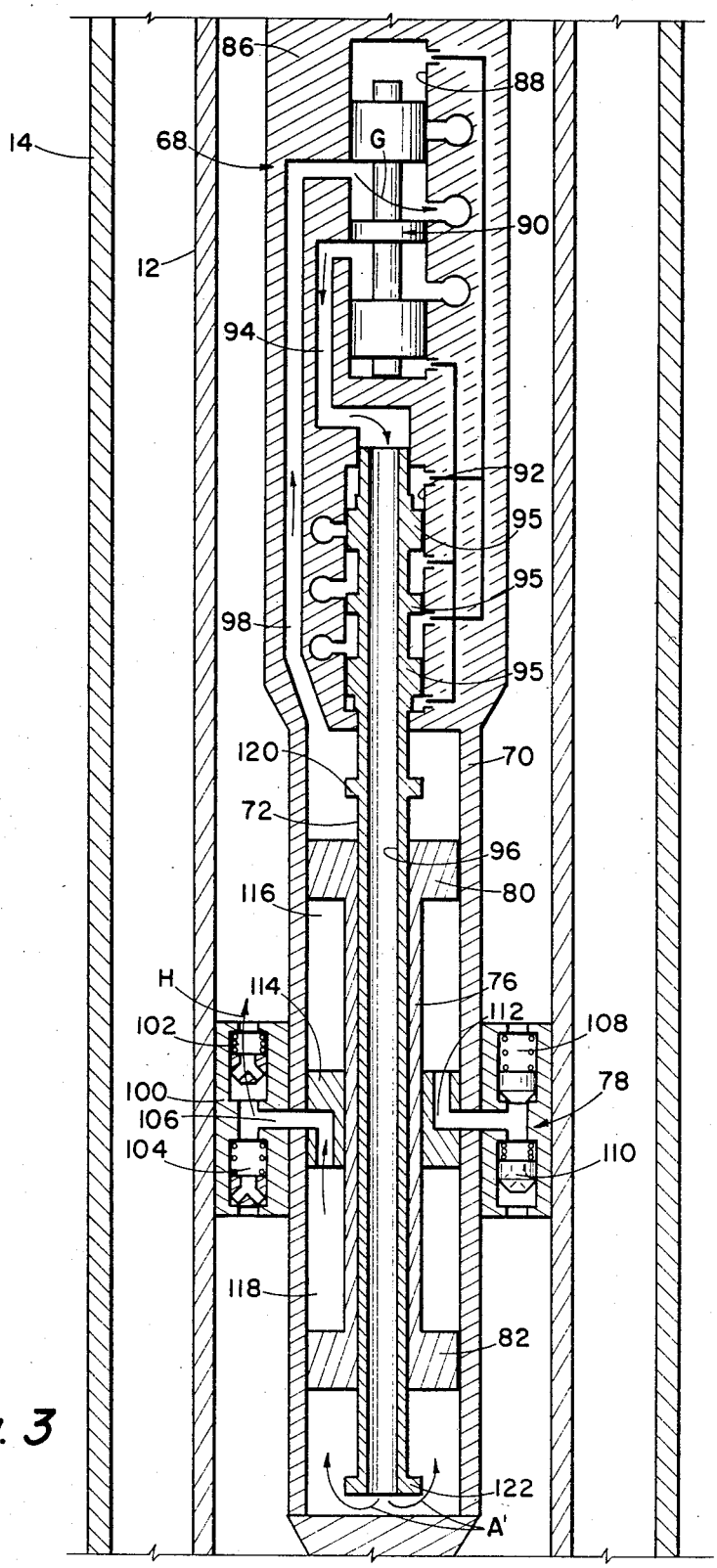
FIG. 3 is a sectional elevational view of a pump element as may be utilized in a submersible down hole pumping unit embodying the invention.

FIG. 3 illustrates one embodiment of the shifting valve 68, shift tube 72 and product valve 78 which may be utilized in a rodless submersible down hole pumping assembly embodying the invention. As shown in FIG. 3, the shifting valve assembly 68 comprises a body member 86 having a central bore 88 having a spool means 90 reciprocally disposed therein, and in communication with pressure fluid in any suitable manner whereby the pressure fluid is circulated to and from the bore 88, as is well known. A second internal chamber 92 is provided in the body 68, and is in communication with the first chamber 88 through a passageway 94. The inner or uppermost end of the shift tube means 72 is slidably disposed within the second chamber 92, and is provided with a plurality of longitudinally spaced lands 95 for cooperation with a passageway system generally indicated at 96 and which provides additional communication between the chamber 94 and the chamber 88 for a purpose as will be hereinafter set forth.

When the spool means 90 is in the position shown in FIG. 3, pressure fluid will be delivered from the chamber 88 to the chamber 92 through the passageway 94 as indiciated by the arrow in the passageway. The pressure fluid is thus delivered to the internal passageway 96 of the shift tube 72 and moves therethrough for discharge through the open outer end thereof, as indicated by the arrows A'. This applies fluid pressure against the outer end of the piston head 82 and moves the piston rod 76 in a direction toward the shifting valve assembly 68, whereupon the fluid contained in the housing 70 between the piston head 80 and the shifting valve 68 will be moved through a passageway 98 which extends in the body 86 between the interior of the housing 70 and the chamber 88. The fluid in the passageway 98 will move in the direction indicated by the arrow in the passageway. The fluid entering the chamber 88 from the passageway 98 will be directed into a return chamber as indicated by the arrow G.

During this action, the product valve assembly 78 is actuated for delivering fluid from the chamber between the piston heads 80 and 82 into the annular chamber 60 and simultaneously draw fluid from the well fluid reservoir into the chamber between the piston heads 80 and 82. The product valve assembly 78 as particularly shown in FIG. 3 comprises a sleeve or annular housing 100 disposed in the annulus between the outer periphery of the sleeve or housing 70 and the inner periphery of the well tubing 12. A first pair of in-line spring urged valves 102 and 104 are provided in the body 100, the valves 102 and 104 being in communication with each other and with the chamber between the heads 80 and 82 through passageway means 106. A second pair of in-line spring urged valves 108 and 110 are provided in the body 100, preferably diametrically opposed with respect to the valves 102 and 104. The valves 108 and 110 are in communication with each other and in communication with the chamber between the piston heads 80 and 82 through passageway means 112. The passageways 106 and 112 both extend through an annular plug or seal means 114 which separates the chamber between the piston heads 80 and 82 into an upper chamber 116 and a lower chamber 118. The passageway 106 is open to the lower chamber 118 and the passageway 112 is open to the upper chamber 116. The valves 102 and 104 are normally closed valves, and are so arranged whereby reciprocation of the piston rod means 76 opens one of the valves and simultaneously closes the other of the valves. Similarly, the valves 108 and 110 are normally closed valves and are so arranged that the reciprocation of the piston rod means 76 opens one of the valves while simultaneously closing the other valve.

When the fluid pressure is acting on the outer face of the piston head 80 as shown in FIG. 3, and the piston rod means 76 is being moved upwardly as viewed in the drawing, the fluid in the chamber 118 is pushed outwardly through the open valve 102 for discharge into the annulus 60, as indicated by the arrow H. Simultaneously, the valve 110 is opened and the fluid from the well bore reservoir is drawn into the chamber 116 through the passageway 112. Of course, it is preferable to provide upper and lower stop members 120 and 122 on the shift tube 72 for limiting the relative movement between the piston rod means 76 and the shift tube 72.

Of course, it will be apparent that one direction of reciprocation of the piston rod means 76 will move the fluid from the chamber 118 through the passageway 106 and open valve 102 for discharge into the annulus 60 while drawing the well fluid from the reservoir into the chamber 116 through the open valve 110 and passageway 112. Movement of the piston rod means 76 in an opposite direction will deliver fluid from the chamber 116 into the annulus 60 through the passageway 112 and open valve 108 while simultaneously drawing the fluid from the well bore reservoir into the chamber 118 through the open valve 104 and passageway 106. Continued reciprocation of the piston rod means 76 will move the well fluid upwardly through the annulus 60 for recovery at the surface of the ground.

Figure 4:
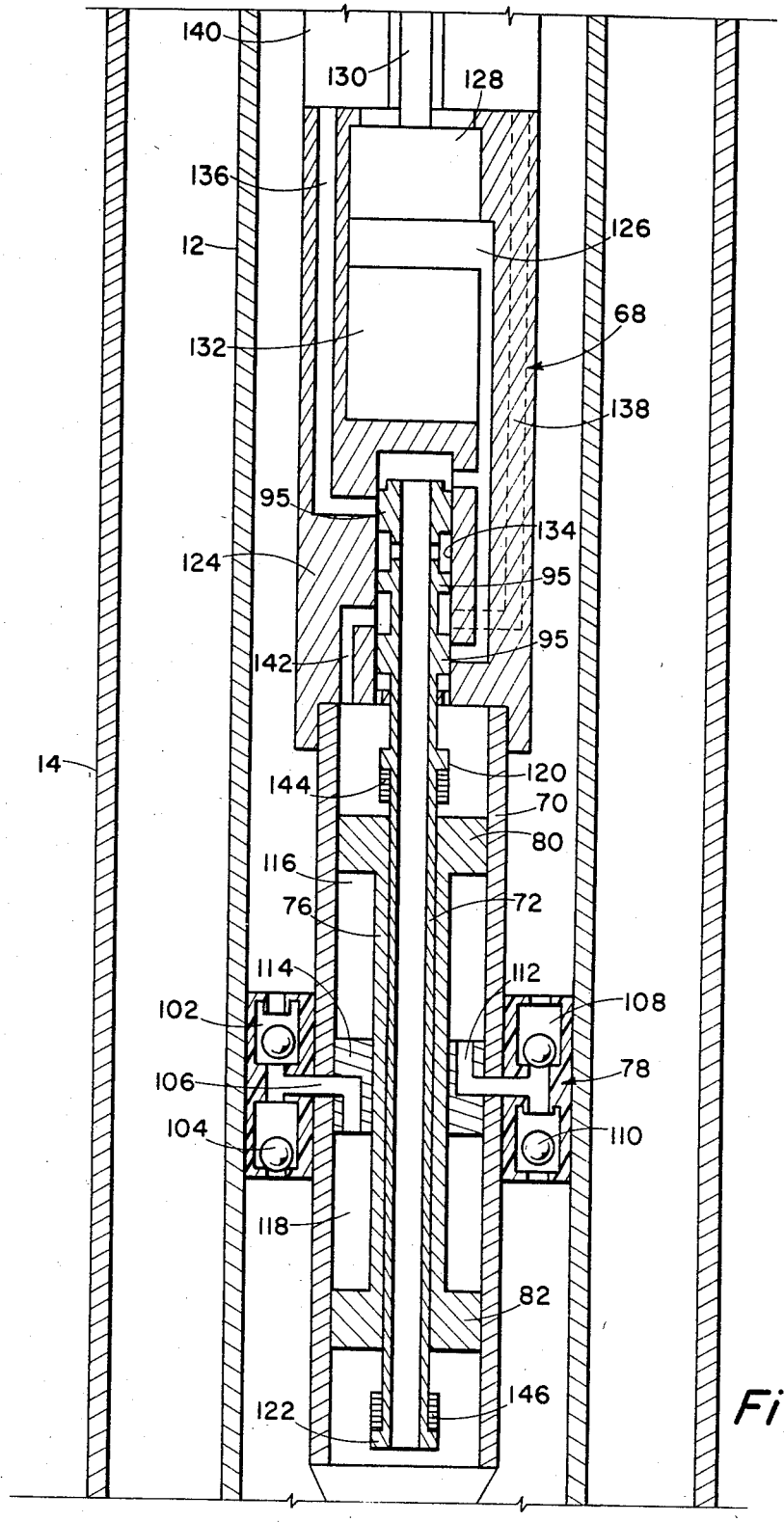
FIG. 4 is a view similar to FIG. 3 illustrating another pump element as may be utilized in a submersible down hole pumping unit embodying the invention.
Figure 5:
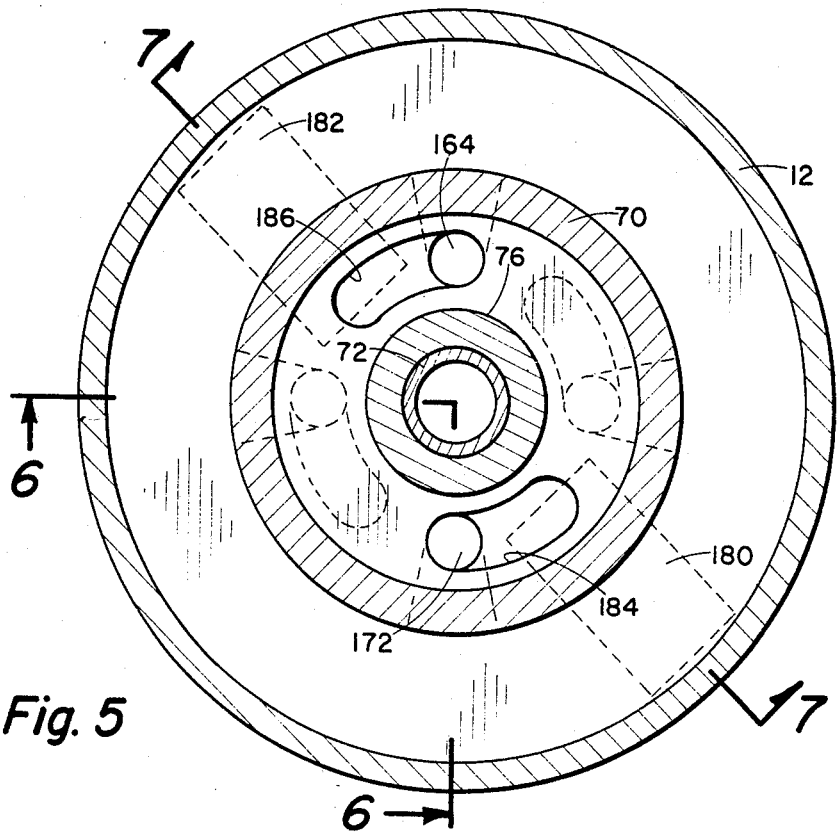
FIG. 5 is a transverse sectional view of a valving element which may be utilized in the pump element portion of a submersible down hole pumping unit embodying the invention.
Figure 6:
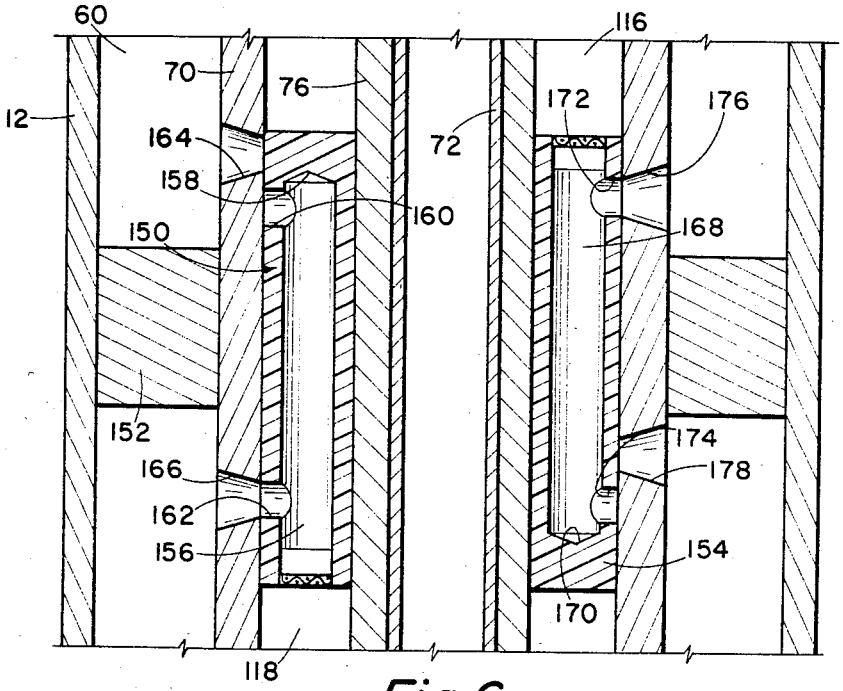
FIG. 6 is a view taken on line 6—6 of FIG. 5.
Figure 7:
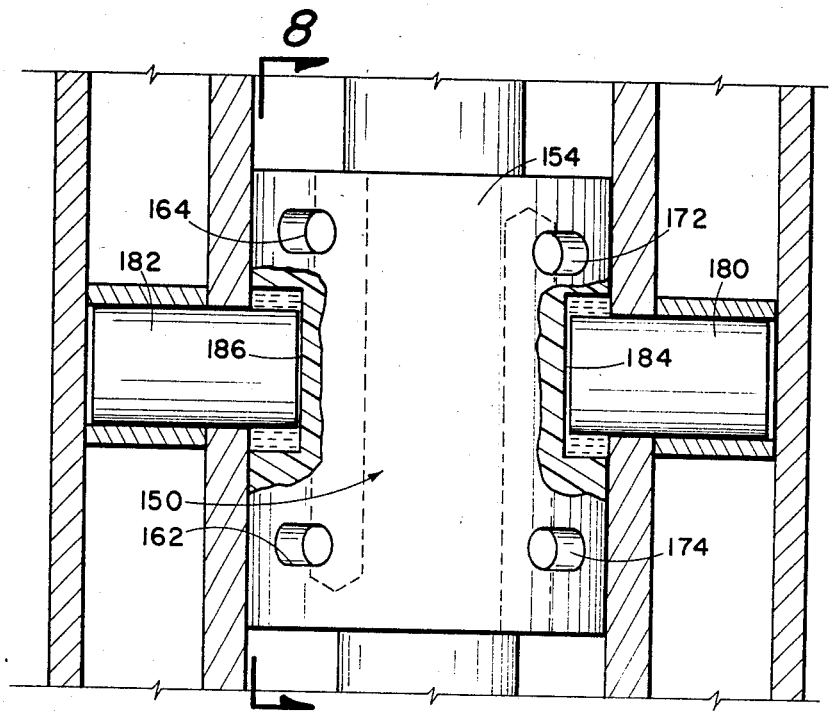
FIG. 7 is a view taken on line 7—7 of FIG. 5.
Figure 8:
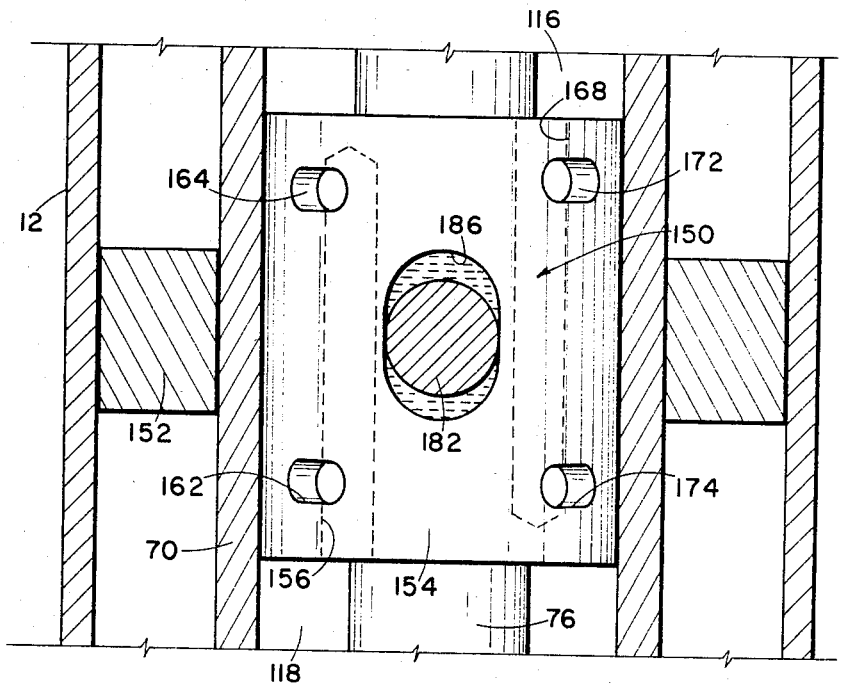
FIG. 8 is a view taken on line 8—8 of FIG. 7.
Figure 9:
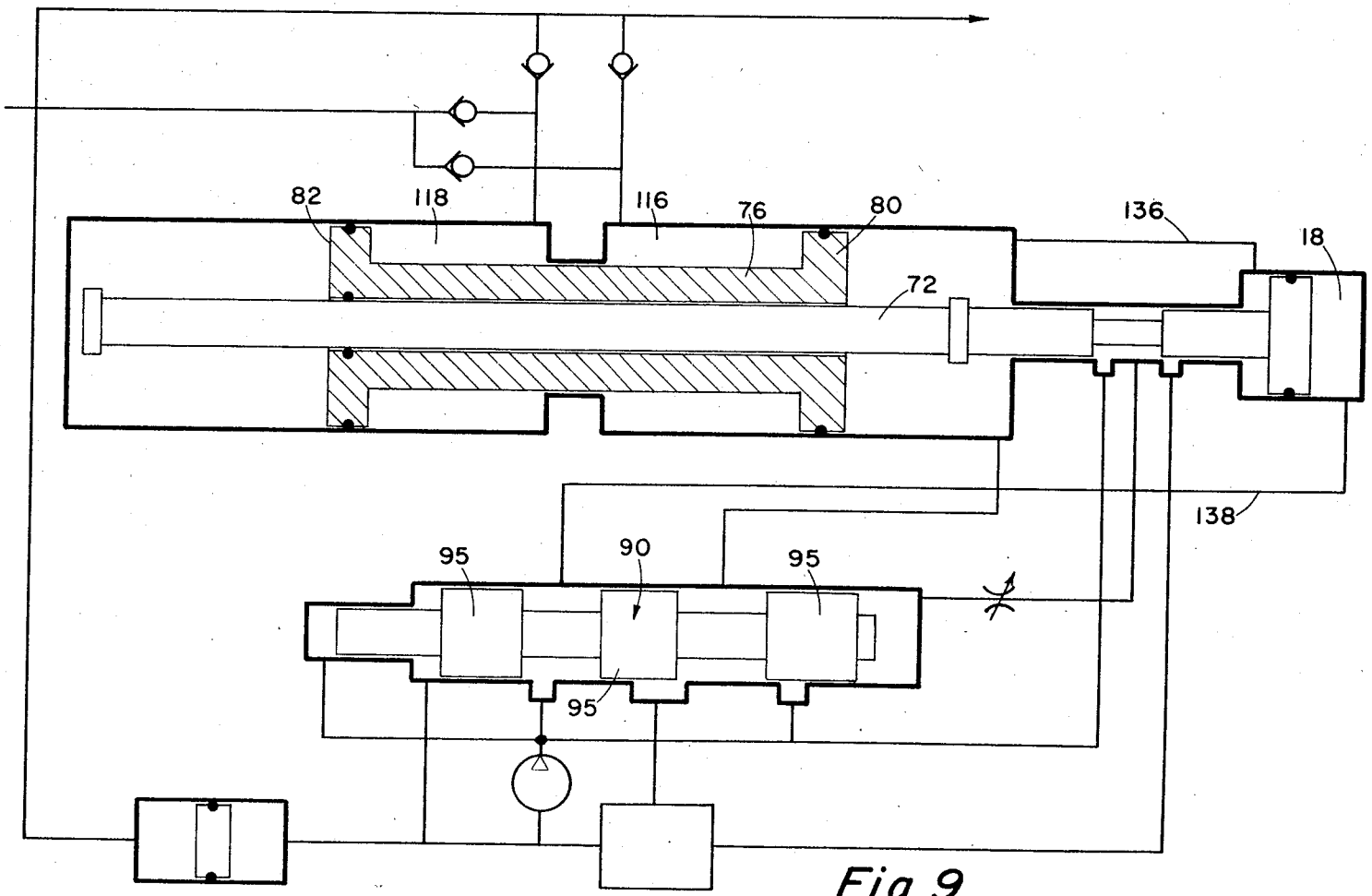
FIG. 9 is a schematic view of a hydraulic system which may be used in a valving apparatus utilized in a submersible down hole pumping unit embodying the invention.

FIG. 4 illustrates another embodiment for the shifting valve means 68. The valve means 68 as shown in FIG. 5 comprises a body 124 having a central bore or chamber 126 provided therein for housing a suitable pump 128 which may be of any suitable type, such as a vane pump, gear pump, or the like. The pump 128 is operably connected with the motor 66, or the like, by a drive shaft 130 for actuation of the pump 128, as is well known. In addition, a suitable pressure accumulator 132 is disposed within the chamber 126. The accumulator 132 may be of any well known type, such as a plastic foam cell, but not limited thereto. The pressure fluid for activation of the shift tube means 72 is contained within the chamber 126 and surrounds the pump 128 for movement thereby. A second chamber 134 similar to the chamber 92 is provided in the body 124 for receiving the uppermost end of the shift tube means 72 therein, as hereinbefore set forth. The chamber 134 is in communication with the plenum or pressure fluid through passageways 136 and 138 suitable filter means 140 whereby the operating fluid will be cleaned during recirculation thereof through the plenum. In addition, the chamber 134 is in communication with the interior of the housing 70 through a passageway means 142. The operation of the embodiment shown in FIG. 4 is substantially identical with the operation of the embodiment shown in FIG. 3, with the piston rod means 76 being reciprocated by the shift rod means 72 whereby the well fluid from the fluid reservoir in the well bore may be elevated to the surface of the well through the product valve means or assembly 78. In the particular embodiment shown in FIG. 4, it may be preferable to provide suitable die spring means 144 and 146 for the stop members 120 and 122, respectively, for dampening the engagement thereof with the head members 80 and 82 during reciprocation of the piston rod means 76.

Referring now to FIGS. 5 through 8, a modified product valving assembly is generally indicated at 150. The assembly 150 is interposed between the outer periphery of the piston rod means 76 and inner periphery of the housing 70, and is preferably in substantial alignment with a suitable annular packing means 152 which isolates the annulus 60 from the fluid reservoir present within the well bore, as is well known. The assembly 150 comprises a sleeve means 154 having a first passageway 156 extending longitudinally therein. One end of the passageway 156 is open to the chamber 118 and the opposite end thereof is closed by a wall member 158. A pair of ports or bores 160 and 162 are provided in the sleeve 154 in communication with the passageway 156. In one position of the assembly 150 with respect to the housing 70, the bores 160 and 164 are misaligned and a pair of spaced bores 162 and 166, respectively, are in alignment. The bores 164 and 166 are disposed on the opposite sides of the packer 152 for a purpose as will be hereinafter set forth.

A second passageway 168 extends longitudinally into the sleeve 154 and has one end open to the chamber 116 and the opposite end closed by a wall 170. A pair of spaced ports or bores 172 and 174 are provided in the sleeve 154 in communication with the passageway 168 and the bores 172 and 176 are in alignment, and a pair of spaced bores 174 and 178, respectively, are misaligned in one relative position of the valve assembly 150 with respect to the housing 70. As the valve assembly 150 moves into and out of register with the bores of the housing 70, the well fluid is drawn into housing 70 and discharged into the annulus 60 for delivery to the surface of the well in the manner as hereinbefore set forth.

Suitable guide pins 180 and 182 (FIG. 7) extend into slidable engagement with recesses 184 and 186, respectively, provided on the outer periphery of the body or sleeve 154 for facilitating the reciprocal movement of the sleeve 154 with respect to the housing 70, if desired.

From the foregoing, it will be apparent that the present invention provides a novel rodless submersible down hole pumping unit comprising a combination of known technologies in a manner not heretofore united to produce an end result not heretofore possible. The novel combination includes a submersible motor operably connected with suitable hydraulic pump means for directing pressure fluid to a shift tube means for reciprocation of a piston rod means whereby the fluid contained in a fluid reservoir in an oil and/or gas well bore may be pulled into the interior of the pumping assembly through a product valve means, and discharged into the annulus between the well tubing and the outer periphery of the apparatus for delivery to the surface of the ground for recovery of the well fluid. The submersible down hole pump assembly may be suspended or inserted into the well tubing by any suitable cable means, or the like, and the motor may be actuated by electrical power from the surface of the ground through a suitable electric cable extending through the well tubing into connection with the apparatus. The entire pumping unit may function in an efficient manner regardless of the depth of the well bore within which it is installed.

Whereas the present invention has been described in particular relation to the drawings attached hereto, it should be understood that other and further modifications, apart from those shown or suggested herein may be made within the spirit and scope of this invention.

What is claimed is:

1. A submersible downhole pump for use in a string of tubing extending from the earth's surface into a fluid producing formation, comprising:

a tubular housing;

a packer means sealing said tubular housing relative to the interior of the tubing string;

a tubular piston rod of external diameter less than the internal diameter of said tubular housing and slideably received within said tubular housing;

top and bottom piston means adjacent the ends of said piston rod slideably and sealably engaging the interior of said tubular housing; and seal means within said tubular housing sealably slideably receiving said piston rod intermediate said piston means;

a tubular shift tube slideably and sealably received within said tubular piston rod;

a motor driven hydraulic pump affixed to said tubular housing within the well tubing providing a source of the hydraulic fluid under pressure, the hydraulic fluid being isolated from the formation fluid;

a valve means in communication with said hydraulic pump produced source of fluid pressure and providing means to direct fluid pressure from said pump between first and second fluid flow paths, one of said flow paths acting on said top piston means to force the piston rod downwardly and the second flow path communicating through said shift tube to act on said bottom piston means to force the piston rod and its piston means upwardly;

means to actuate said valve means to apply fluid pressure to said first and second fluid flowpaths in response to the movement of said shift tube which, in turn, is moved in response to the movement of said piston rod;

valve means in communication with the interior of the tubing string above and below said packet means and the interior of said tubular housing above and below said seal means for causing flow of formation fluid within the tubing string from below said packer means to above said packer means and thence to the earth's surface as said piston rod is reciprocated; and means to superimpose the pressure of the formation fluid within said tubing string above said packer means upon said hydraulic fluid.

2. A submersible downhole pump according to claim 1 including:

a tubular means having one end in communication with said hydraulic fluid and the other end in communication with said formation fluid within said tubing string above said packer; and a free floating piston means within said tubular means separating said hydraulic fluid and formation fluid.

3. Submersible down hole pumping apparatus as set forth in claim 1 wherein the valve means comprises at least one pair of coacting valves alternately opened and closed with respect to each other for admitting the well fluid into the reciprocal pumping means and discharging the well fluid therefrom.

4. Submersible down hole pumping apparatus as set forth in claim 3 wherein the coacting valves are normally closed valves responsive to the reciprocal action of the tubular piston rod for opposed opening and closing with respect to each other.

* * * * *